US007347270B2

(12) United States Patent
McMillan et al.

(10) Patent No.: US 7,347,270 B2
(45) Date of Patent: Mar. 25, 2008

(54) REDUNDANT HYDRAULIC SYSTEM FOR SAFETY VALVE

(75) Inventors: Timothy J. McMillan, Missouri City, TX (US); Dwayne E. May, Humble, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 167 days.

(21) Appl. No.: 11/163,444

(22) Filed: Oct. 19, 2005

(65) Prior Publication Data

US 2006/0086509 A1 Apr. 27, 2006

Related U.S. Application Data

(60) Provisional application No. 60/522,613, filed on Oct. 20, 2004.

(51) Int. Cl.
*E21B 34/10* (2006.01)

(52) U.S. Cl. ..... 166/332.8; 166/321; 166/375

(58) Field of Classification Search ..... 166/321, 166/332.1, 332.8, 373, 374, 375, 323
See application file for complete search history.

(56) References Cited

U.S. PATENT DOCUMENTS

| | | | | |
|---|---|---|---|---|
| 3,786,865 | A | 1/1974 | Tausch | |
| 3,786,866 | A | 1/1974 | Tausch | |
| 4,356,867 | A | 11/1982 | Carmody | |
| 4,411,316 | A | 10/1983 | Carmody | |
| 4,624,315 | A | 11/1986 | Dickson | |
| 4,660,646 | A | 4/1987 | Blizzard | |
| 4,676,307 | A | 6/1987 | Pringle | |
| 4,723,606 | A | 2/1988 | Vinzant | |
| 4,796,705 | A * | 1/1989 | Carmody et al. | 166/323 |
| 4,838,355 | A * | 6/1989 | Leismer et al. | 166/375 |
| 4,951,753 | A * | 8/1990 | Eriksen | 166/375 |
| 5,127,476 | A | 7/1992 | Dickson | |
| 5,167,284 | A * | 12/1992 | Leismer | 166/374 |
| 5,310,004 | A | 5/1994 | Leismer | |
| 5,343,955 | A * | 9/1994 | Williams | 166/386 |
| 6,491,106 | B1 * | 12/2002 | Simonds | 166/375 |
| 6,513,594 | B1 | 2/2003 | McCalvin | |
| 6,575,249 | B2 | 6/2003 | Deaton | |
| 6,705,593 | B2 | 3/2004 | Deaton | |
| 2003/0234104 | A1 | 12/2003 | Johnston | |

FOREIGN PATENT DOCUMENTS

| | | |
|---|---|---|
| EP | 1241322 A1 | 9/2002 |

* cited by examiner

*Primary Examiner*—Jennifer H. Gay
*Assistant Examiner*—Daniel P Stephenson
(74) *Attorney, Agent, or Firm*—Trop, Pruner & Hu, P.C.; Dona C. Edwards; Bryan P. Galloway

(57) ABSTRACT

A subsurface safety valve for controlling a fluid flow through a well conduit includes a housing having a bore and disposed within an annulus defined by the space between the well conduit and the housing, a valve closure member movable between an open position and a closed position, and adapted to restrict the fluid flow through the bore when in the closed position, a flow tube moveably disposed within the housing and adapted to shift the valve closure member between its open and closed positions, a primary piston member in operative communication with the flow tube and a secondary piston member in operative communication with the flow tube.

20 Claims, 2 Drawing Sheets

REDUNDANT HYDRAULIC SYSTEM FOR SAFETY VALVE

FIELD OF THE INVENTION

The present invention relates to subsurface well equipment and, more particularly, to a subsurface safety valve.

DESCRIPTION OF THE RELATED ART

The use of subsurface safety valves in oil and gas wells is well known. U.S. Pat. No. 4,660,646 to Blizzard, which is fully incorporated herein by reference, describes the use of a "flapper" type valve disposed within the well bore which is opened and closed with a flow tube, generally a cylindrical tube which moves telescopically within the well bore. The Blizzard flow tube is actuated using a piston and cylinder assembly. One of the piston or cylinder is attached to the flow tube, and when hydraulic pressure is applied to the piston, the piston moves down as does the flow tube, thereby actuating the safety valve to an open position.

It is also well known that the fluid column acting on the piston and cylinder assembly to open the subsurface safety valve applies ever greater pressure the deeper the piston and cylinder assembly is set into the earth. Therefore, the force required to lift the flow tube, and close the valve, increases accordingly. Generally, spring force and sometimes hydraulic pressure is used to lift the flow tube and close the valve. Occasionally, the piston and cylinder assembly used to lift the flow tube fails due to seal wear or other well known mechanical failure. In the case of such a mechanical failure, if the aforementioned spring is not strong enough to overcome the force applied by the fluid column, the valve will fail in the open position. A failure in the open position is generally undesirable as being unsafe, and operationally inefficient. As such, various techniques have been employed to ensure that in the event of a failure, the valve will fail in the closed position.

The present invention is directed to a subsurface safety valve that, in the event of a failure, fails in the closed position.

SUMMARY OF THE INVENTION

The present invention has been contemplated to meet the above described needs. In a broad aspect, the invention may include a subsurface safety valve for controlling a fluid flow through a well conduit comprising a housing having a bore and disposed within an annulus defined by the space between the well conduit and the housing, a valve closure member movable between an open position and a closed position, and adapted to restrict the fluid flow through the bore when in the closed position, a flow tube moveably disposed within the housing and adapted to shift the valve closure member between its open and closed positions, a primary piston member in operative communication with the flow tube and a secondary piston member in operative communication with the flow tube.

BRIEF DESCRIPTION OF DRAWINGS

For a detailed description of the preferred embodiments of the invention, reference will now be made to the accompanying drawings wherein.

DETAILED DESCRIPTION

For purposes of this description, the terms "upper," "lower," "up," "down," "uphole," and "downhole" are relative terms to indicate position and direction of movement in easily recognized terms. Usually these terms are relative to a line drawn perpendicularly downward from the center of the borehole at the earth's surface, and would be appropriate for use in straight, relatively vertical wellbores. However, when the wellbore is highly deviated, such as from about horizontal to about 60 degrees from vertical, or if there are multiple laterals, these usually comfortable terms to persons skilled in the art may not make sense. Use of these terms are for ease of understanding as an indication to what relative position or movement would be if the well were vertical, and should not be construed to limit the scope of the invention.

Figure 1:
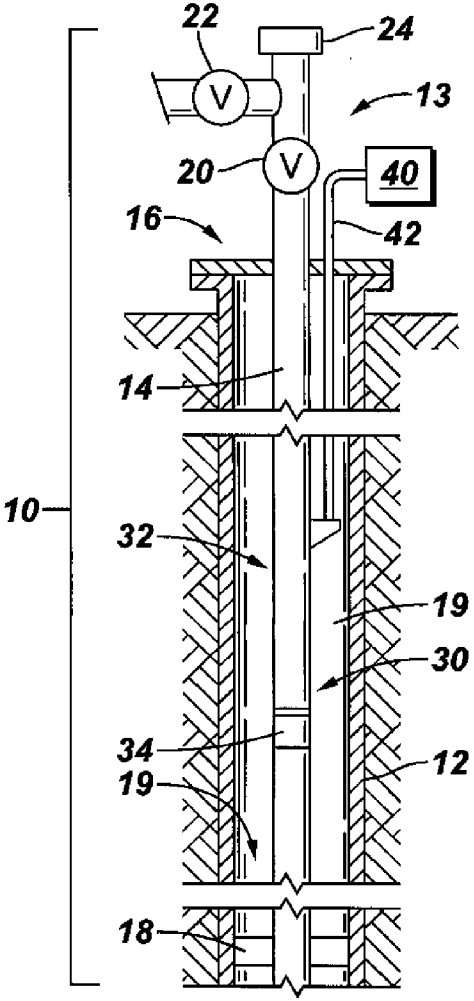
FIG. 1 (Prior Art)
FIG. 1 is a schematic view in section and elevation of a typical well completion including a subsurface safety valve.

Referring to FIG. 1, an exemplary environment within which the present invention may be used is shown as a conventional oil and gas production well or well completion 10, as is known in the art. The illustrated well completion 10 includes a casing string 12 extending from the well surface 13 to a hydrocarbon production formation (not shown). A tubing string 14 is shown concentrically disposed within the casing string 12, and extends from a wellhead 16 through a production packer 18. The production packer 18 of FIG. 1 seals the annulus formed between the tubing and casing strings 14, 12, and directs formation fluids, such as oil, gas and water, into the tubing string 14 that are admitted into the well bore 19 through perforations (not shown) in the casing string 12. Valves 20, 22, which are helpful in controlling fluid flow from the tubing string 14, are shown at the well surface 13. A wellhead cap 24 is useful, for example, to permit servicing the well 10 via tubing string 14 with wireline equipment (not shown).

Still referring to the exemplary environment of FIG. 1, a flow control device 30 is shown installed in the well 10 as a part of the tubing string 14 to assist in controlling fluid flow to the well surface 13 through the tubing string 14 from downhole, as is also known in the art. The illustrated flow control device 30 is a conventional, surface-controlled subsurface safety valve 32 connected in the tubing string 14, such as by suitable threaded connections. The device 30 may be operated, for example, by control fluid conducted from a hydraulic manifold 40 at the well surface through a control line conduit 42. Further explanation of the components, arrangement and operation of a conventional well completion and related equipment can be found in prior art patents and other publications, such as U.S. Pat. Nos. 4,723,606, 4,624,315 and 5,127,476, each of which is hereby incorporated by reference herein in its entirety.

The above description and further aspects of a conventional well completion having one or more underground oilfield tubulars and a subsurface safety valve are known in the art and in no way limiting upon the present invention or the appended claims. Moreover, the present invention is not limited to use in the environment of a well completion, oil and gas production well or oilfield tubular, but may be used in any environment where it is desired to be able to retain a valve member of a flow control device having a bore in an open position.

Figure 2B:
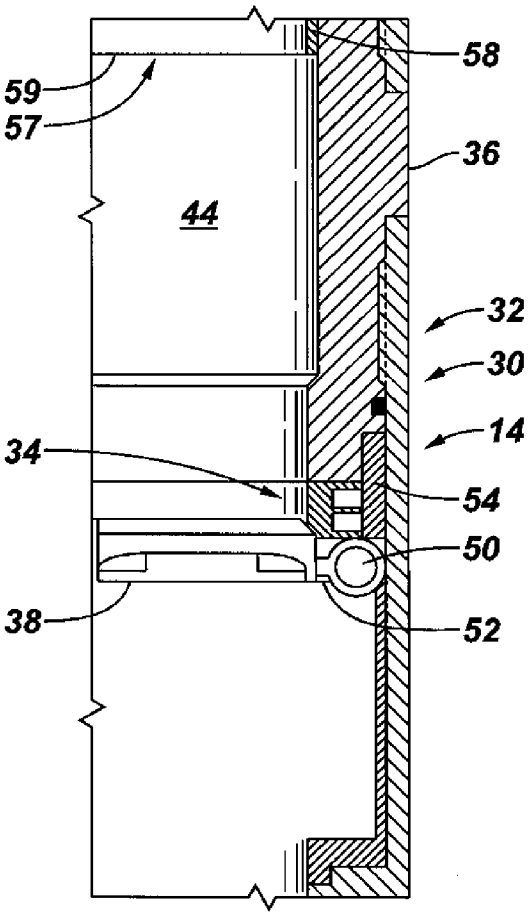
FIG. 2B (Prior Art)
FIG. 2B is a fragmentary elevational view, partly in cross section, showing a typical flapper type safety valve in a closed position.
Figure 2A:
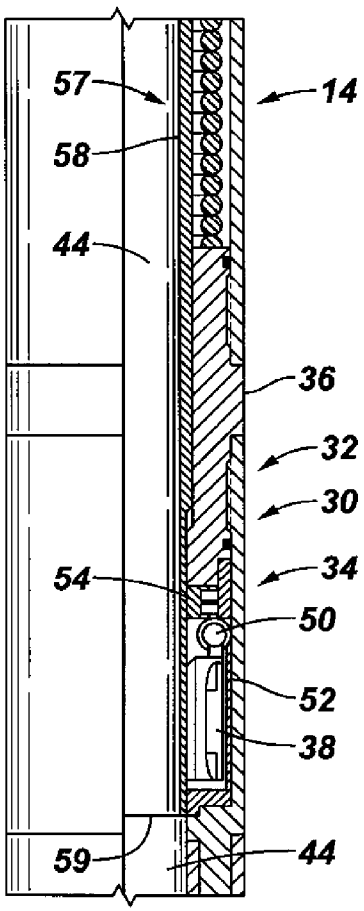
FIG. 2A (Prior Art)
FIG. 2A is a fragmentary elevational view, partly in cross section, showing a typical flapper type safety valve in an open position.

Now referring to FIGS. 2A and 2B, the illustrated safety valve 32 is a conventional flapper type valve assembly 34 generally including a valve housing or body 36 and a flapper member 38. The flapper member 38 is pivotably mounted in the valve housing 36 upon a pin 50 and is movable between at least one open position (FIG. 2A) and at least one closed position (FIG. 2B) relative to a central, longitudinally extending bore 44 through the valve housing 36. A valve opening device 57 is used to open the flapper member 38. In the illustrated valve 32, the valve opening device 57 is a reciprocating tubular member 58 movable downwardly into contact with the flapper member 38 to push it off of a valve seat 54 into an open position, as is known in the art. By maintaining a downward position of the tubular member 58, whereby the tubular member 58 remains engaged with the flapper member 38 and is thus in an "engaged position", the flapper member 38 is (at least temporarily) held in an open position, permitting fluid flow through the bore 44 and well tubing 14, such as during normal operations.

Still referring to FIGS. 2A and 2B, to allow the conventional flapper member 38 to move from an open to a closed position, the tubular member 58 of the exemplary configuration is moved upwardly out of its engaged position. As the lower end 59 of the tubular member 58 moves above the valve seat 54, the spring force of a spring 52 and/or the upward fluid flow through the tubing string 14 and bore 44 moves the flapper member 38 into a closed position. In FIG. 2B, the flapper member 38 is shown yieldably urged about the pin 50 by the spring 52 into a closed position. In this position, the flapper member 38 of FIG. 2 abuts the annular valve seat 54, thus blocking upward flow of fluid through the bore 44 and tubing string 14 (FIG. 1). These and other aspects of the illustrated safety valve are known in art. Further explanation of the components, arrangement and operation of conventional safety valves, such as the flapper type valve assembly 34, and valve opening devices, such as the tubular member 58, are more fully described in prior art patents and publication, such as U.S. Pat. Nos. 3,786,865, 3,786,866, 4,624,315, 5,127,476, 4,411,316, 4,356,867 and 4,723,606, each of which is hereby incorporated by reference herein in its entirety.

The above description and further aspects of safety valves, such as the flapper type valve assembly 34, and valve opening devices, such as the tubular member 58, are in no way limiting upon the present invention or the appended claims. Moreover, the present invention is not limited to use with a flapper type valve, or tubular member type valve opening device, but can be used in connection with any suitable type of flow control device with, or without, any suitable type of valve opening device.

Figure 3A:
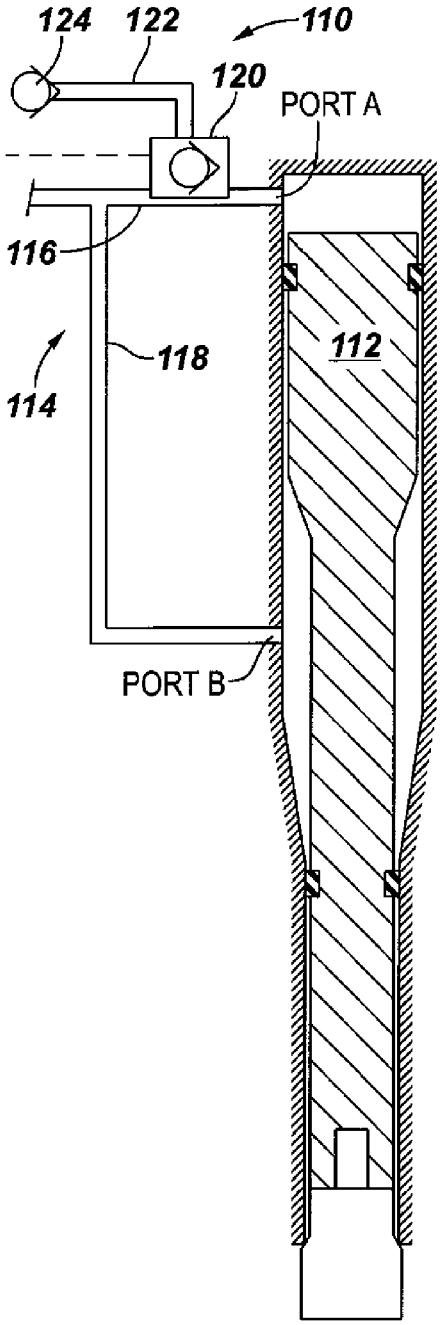
FIG. 3A shows a schematic view of a primary hydraulic system for a safety valve constructed in accordance with the present invention.

Referring to FIG. 3A, a primary hydraulic system 110 comprises a primary piston 112 and a primary hydraulic circuit 114. Primary piston 112 has, in the embodiment shown, different upper and lower surface areas on which fluid pressure can bear. The lower surface of primary piston 112 is in operative communication with flow tube 59, such that downward movement of the primary piston 112 causes downward movement of the flow tube 59. Primary piston 112 may be in direct or indirect, hydraulic or mechanical, contact with the flow tube 59.

Primary hydraulic circuit 114 is in fluid communication with a pressure source (not shown) such as a pump and reservoir at the surface, and includes flowpaths 116, 118 to a port A and a port B, respectively. A primary valve 120 is disposed in flowpath 116 leading to port A. Primary valve 120 can be, for example, a shuttle valve, but is not restricted to that type of valve. Primary valve 120 does not regulate flow through port B. Primary hydraulic circuit 114 also includes a discharge flowpath 122 to discharge fluid from primary hydraulic circuit 114 to a region outside the circuit, such as into the annulus of a well bore. Discharge flowpath 122 may also discharge fluid to an internal chamber or return line to the surface or other contained volumes. Discharge flowpath 122 can be opened or closed by a vent valve 124.

Figure 3B:
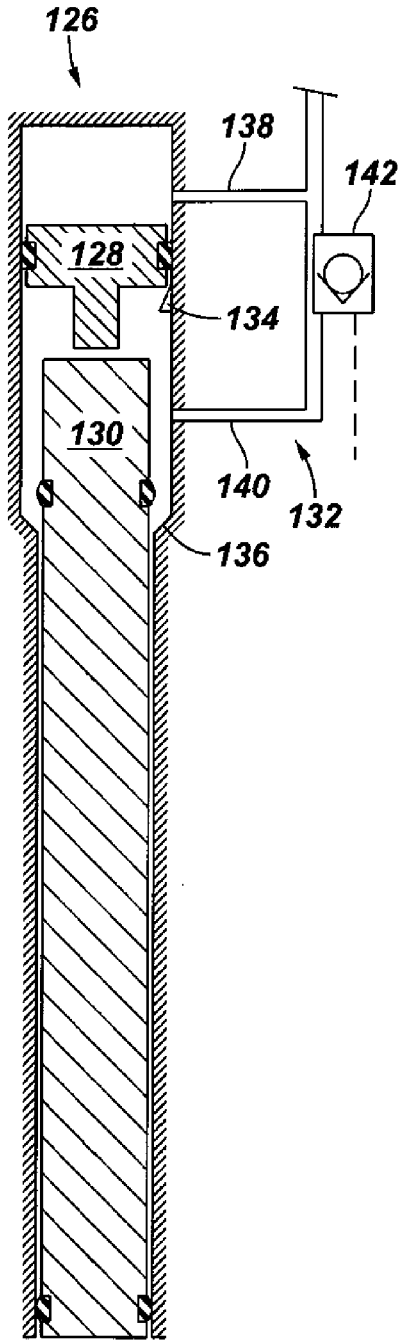
FIG. 3B shows a schematic view of a secondary hydraulic system for a safety valve constructed in accordance with the present invention.

FIG. 3B shows a secondary hydraulic system 126 separate from primary hydraulic system 110, except in some embodiments hydraulic systems 110, 126 could share a common source line to the pressure source. Secondary hydraulic system 126 may also share a common control line for valve operation. Alternatively, secondary hydraulic system 126 may be wholly or partially independent of the primary hydraulic system 110 to allow for full redundant operation. It should be noted for purposes of this application, redundant operation includes operation of the primary hydraulic system 110 and the secondary hydraulic system 126, such that the secondary hydraulic system 126 can be operated to open flapper valve 38 without contribution from the primary hydraulic system 110. Specifically, in the event of a failure of primary hydraulic system 110, such as in the case of seal failure, the secondary hydraulic system is operated to maintain or re-establish downward pressure on the flow tube 59, thus forcing flapper valve 38 to an open position.

Secondary hydraulic system 126 comprises an upper piston 128, a lower piston 130, and a secondary hydraulic circuit 132. Upper piston 128 is configured to be in abutting contact with lower piston 130. A lock 134 is disposed in a housing 136 within the range of motion of upper piston 128. The lock 134 may be any form of motion restricting device, such as a detent or a profile or such as a moveable latch. In any form, lock 134 restricts downward movement of the upper piston 128. In a dormant position, the upper piston 128 lies above the lock 134. To activate the secondary hydraulic system 126, the upper piston 128 is moved beyond lock 134. For example, lock 134 may comprise a profile having a constricted inner diameter that is rated to prevent downward movement of the upper piston 128 below a predefined pressure threshold. Alternatively, lock 134 may comprise a moveable latch that can be controlled either with a separate control line, electric or hydraulic, or via a run in tool to move the lock 134.

Secondary hydraulic circuit 132 is in fluid communication with a pressure source (not shown) such as a pump and reservoir at the surface, and includes upper and lower flowpaths 138, 140, respectively. A secondary valve 142, a shuttle valve for example, is disposed lower flowpath 140. As stated above, the pressure source for the secondary hydraulic circuit 126 may be shared with the pressure source for the primary hydraulic system 110. In such case, a lock 134 in the form of a profile would be rated to hold the position of the upper piston 128 above a pressure normally applied to the primary hydraulic system 110. In other words, according to an embodiment, a same pressure is applied to both the primary piston 112 and the upper piston 128. However, since the lock 134 is rated to hold above such pressure, only primary piston 112 is moved. Alternatively, the pressure sources for each hydraulic circuit may be independent of one another with separate control lines run to the piston 112 and pistons 128 and 130 respectively. Valves 120, 124, 142 can be controlled hydraulically, mechanically, or by using various other means well known in the art.

The upper or shuttle piston 128 above the lower or secondary piston 130 has primary communication to system pressure. This shuttle piston 128 is merely one method of shifting the seals of the lower piston 130 into the piston bore of the housing 136. It could be performed mechanically as well as hydraulically. For example, according to one embodiment, the shuttle piston 128 is separate from the lower piston 130 such that the travel of shuttle piston 128 is restricted to a down stop (not shown) and will not interfere with the operation of the secondary piston 130, for example be restrict from movement across flow path 140. Once the shuttle piston 128 shifts the seals of the secondary piston 130 into service, the previously dormant seals of the secondary piston 130 will assume hydraulic operation when valve 142 is activated to allow flow to path 140.

Primary hydraulic system 110 and secondary hydraulic system 126 are located in separate chambers within housing 36. Although many configurations are possible, according to one embodiment, the primary hydraulic system 110 is located on an opposite side of the housing 36 compared to the secondary hydraulic system 126. Both the primary piston 112 and the lower piston 130 are in operative communication with the flow tube 59, such that downward movement of either the primary piston 112 or the lower piston 130 causes downward movement of the flow tube 59. Further, lower piston 130 is independent or redundant of the primary piston 112, such that downward movement of the flow tube 59 is effected either by primary piston 112 independent of any motion of lower piston 130 or by lower piston independent of any motion of primary piston 112.

In operation, primary hydraulic system 110 is used to control the motion of primary piston 112. Vent valve 124 is normally closed and primary valve 120 is normally open. Pressurized fluid passing through flowpaths 116, 118 causes primary piston 112 to displace downward due to the differential areas. Specifically, the downhole force applied by the pressure in flowpath 116 to the top of primary piston 112 is greater than the uphole force applied by the pressure in flowpath 118 to the angled surfaces of primary piston 112. In a typical application such as a safety valve, the downward displacement of primary piston 112 causes the lower end of primary piston 112 (or some other surface or hydraulic connection) to bear on a shoulder of a flow tube and displace the flow tube accordingly downward. The downward displacement of the flow tube opens a flapper valve to permit production of well fluids. If hydraulic pressure is removed from flowpaths 116, 118, tubing pressure and a spring bias tend to drive the flow tube and primary piston 112 upward to allow the flapper valve to close, halting well production. In a closed position, when the primary piston is positioned fully upward, a metal static seal is effected between the piston chamber and the lower end of the piston.

Primary hydraulic system 110 also allows primary piston 112 to be hydraulically driven upward if desired. That could be the case, for example, in the event of a failure somewhere in the primary hydraulic system. If vent valve 124 is opened and primary valve 120 is closed, then pressurized fluid can be directed into flowpath 118 only and will drive primary piston 112 upward while hydraulic fluid above primary piston 112 is discharged, into the well annulus for example, through discharge flowpath 122. Valve 120 only shuts off flow from system pressure to path 116. Path 116 and valve 124 are in series with the pressure on top of piston 112. The shifting of valve 120 would only be used if you wanted to disable the primary piston (i.e. should you have a seal leak). Then you would open valve 124 to allow system pressure or bore pressure to act to close the piston by pushing the fluid from the top of the piston to the annulus.

To regain operational control of the safety valve, should operational control using primary hydraulic system 110 be lost, secondary hydraulic system 126 can be activated. With secondary valve 142 in a closed state, pressurized fluid passing through upper flowpath 138 will drive upper piston 128 downward, below lock 134. As mentioned above, this movement may be effected either by exceeding the rated pressure threshold of a profile against the upper piston 128, or via movement of a mechanical lock through a control or separate run in operation, or by other methods known in the art. According to one embodiment, lock 134 also prevents upward movement of upper piston 128 once secondary hydraulic system 126 is activated, such as shifting to far upward and uncovering the hydraulic seal. According to another embodiment there is a down stop (not shown) for upper piston 128, for example to restrict movement past flowpath 140. The downward motion of upper piston 128 drives lower piston 130 downward. Opening secondary valve 142 allows pressurized fluid into lower flowpath 140, which further drives lower piston 130 downward. Lower piston 130 controls the motion of the flow tube in place of primary piston 112 in a similar manner.

The advantages of the present invention include convenient methods that allow for redundant secondary hydraulics to control operation of a safety valve. These methods can be employed in a cost effective and efficient manner, providing an additional fail safe mode of operation.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A subsurface safety valve for controlling a fluid flow through a well conduit comprising:

a housing having a bore and disposed within an annulus defined by the space between the well conduit and the housing;

a valve closure member movable between an open position and a closed position, and adapted to restrict the fluid flow through the bore when in the closed position;

a flow tube moveably disposed within the housing and adapted to shift the valve closure member between its open and closed positions;

a primary piston assembly including a primary piston member in sliding relationship with a primary cylinder, the primary piston member in operative communication with the flow tube;

a secondary piston assembly including a secondary piston member in sliding relationship with a secondary cylinder, the second piston member in operative communication with the flow tube; and a mechanism to selectively translate the secondary piston member between a first position at which the secondary piston member is not responsive to a control stimulus and a second position at which the secondary piston is responsive to the command stimulus.

2. The subsurface safety valve of claim 1, wherein the primary piston member is a rod piston.

3. The subsurface safety valve of claim 1, wherein the secondary piston member is a rod piston.

4. The subsurface safety valve of claim 1, further comprising:

a primary hydraulic circuit in operative communication with the primary piston member for biasing the primary piston to move the flow tube; and a secondary hydraulic circuit in operative communication with the secondary piston member for biasing the secondary piston to move the flow tube.

5. The subsurface safety valve of claim 4, wherein a failure of the primary hydraulic circuit causes the valve closure member to move to its closed position.

6. The subsurface safety valve of claim 4, the secondary hydraulic circuit comprising at least a first flowpath communicating hydraulic pressure to bias the secondary piston to a first position and a second flowpath communicating hydraulic pressure to bias the secondary piston to a second position.

7. The subsurface safety valve of claim 1, wherein the mechanism comprises an upper piston in operative communication with the secondary piston member.

8. The subsurface safety valve of claim 7, the upper piston having at least a first position and a second position, wherein upward movement within the cylinder is restricted when in the second position.

9. The subsurface safety valve of claim 7, further comprising a lock to restrict movement of the upper piston.

10. The subsurface safety valve of claim 9, the lock comprising a profile having a reduced inner diameter.

11. The subsurface safety valve of claim 9, the lock comprising a movable latch.

12. The subsurface safety valve of claim 1, wherein the primary cylinder is independent of the secondary cylinder.

13. The subsurface safety valve of claim 1, wherein flow tube is movable by the secondary piston independent of the primary piston.

14. The subsurface safety valve of claim 1, wherein flow tube is movable by operation of the secondary hydraulic circuit independent of the primary hydraulic circuit.

15. The subsurface safety valve of claim 1, wherein the control stimulus comprises a pressure communicated from the surface of a well.

16. The subsurface safety valve of claim 1, further comprising:

a seal attached to the secondary piston member, wherein the seal is positioned in the secondary cylinder when the secondary piston member is in the second position and the seal is positioned outside of the secondary cylinder when the second piston member is in the first position.

17. A method of operating a subsurface safety valve, comprising the steps of:

reducing hydraulic pressure applied to a primary piston assembly;

translating a piston member of a secondary piston assembly between a first position at which the piston member does not respond to hydraulic pressure and a second position at which the piston member responds to hydraulic pressure;

applying hydraulic pressure to the secondary piston assembly;

moving a flow tube in response to pressure applied to the secondary piston; and opening a valve in response to the flow tube motion.

18. The method claim 17, wherein the step of moving the flow tube is independent of operation of the primary piston.

19. The method claim 17, wherein the step of applying hydraulic pressure to a secondary piston assembly, further comprises the steps of:

moving the secondary piston beyond a lock device in response to the application of hydraulic pressure that exceeds a predefined pressure threshold.

20. The method of claim 17, wherein the act of translating the piston member comprises:

translating the piston member between the first position at which a seal of the piston member is located outside of a cylinder of the secondary piston assembly and the second position at which the seal is located inside the cylinder of the secondary piston assembly.

* * * * *